United States Patent [19]

Zwick

[11] Patent Number: 4,534,601

[45] Date of Patent: Aug. 13, 1985

[54] LIFT ASSEMBLY FOR MOVABLE CABINET

[75] Inventor: David J. Zwick, Stoystown, Pa.

[73] Assignee: The Coleman Company, Inc., Wichita, Kans.

[21] Appl. No.: 580,654

[22] Filed: Feb. 16, 1984

[51] Int. Cl.[3] ..... A47B 49/00

[52] U.S. Cl. ..... 312/266; 296/24 R; 312/201

[58] Field of Search ..... 312/266, 268; 74/98, 74/108; 296/24 R

[56] References Cited

U.S. PATENT DOCUMENTS

| | | | |
|---|---|---|---|
| 3,294,256 | 12/1966 | Nazali et al. | 74/108 |
| 3,472,219 | 10/1969 | Roy et al. | 312/312 |
| 4,150,861 | 4/1979 | Dufrancatel | 312/266 |

*Primary Examiner*—William E. Lyddane
*Assistant Examiner*—Joseph Falk

[57] ABSTRACT

A movable galley for camping trailers and the like includes a pair of cabinets, one of the cabinets being movable between a use position in which it is supported by the other cabinet and a storage position in which it is positioned along side the other cabinet. The support assembly supports the first cabinet as it moves and maintains the cabinet in an upright position. The support assembly includes a pair of sprockets which are non-rotatably mounted on the two cabinets, a link which extends between the sprockets and is rotatably connected thereto, and a chain which extends around the sprockets.

13 Claims, 18 Drawing Figures

LIFT ASSEMBLY FOR MOVABLE CABINET

BACKGROUND

This invention relates to a movable cabinet, and, more particularly, to a movable cabinet which is maintained in an upright position as it moves.

The invention finds particular utility in a galley for a camping trailer or other recreational vehicle. The galley of a camping trailer conventionally includes a pair of cabinets. One of the cabinets is supported by the floor of the vehicle and provides storage space for pans, etc. The other cabinet is movable between a use position in which it is supported by the first cabinet and a storage position in which it is supported by the floor of the vehicle. The movable cabinet may be equipped with, for example, a sink, a cooking area, etc.

The heights of the two cabinets are such that the top of the movable cabinet will be positioned at a convenient height when it is in the use position. However, when the camping trailer is folded into its traveling position, the movable cabinet must be moved to a lower, storage position to permit the camping trailer to be folded into its compact traveling configuration.

Various mechanisms have been used to permit the height of the galley to be reduced for traveling. For example, the upper or movable cabinet can be connected to the lower cabinet by a piano hinge so that the upper cabinet can be pivoted into a lower position. However, when this is done, the upper cabinet is turned upside down, and anything stored in the upper cabinet will also be turned upside down. U.S. Pat. No. 3,472,219 describes a galley in which the upper cabinet is telescopingly supported by the lower cabinet. However, when the upper cabinet is telescoped downwardly into the lower cabinet, the storage space in the lower cabinet is severely reduced or eliminated.

U.S. Pat. No. 4,150,861 describes an upper cabinet which is movable with respect to a lower cabinet by means of a lever arm. The lever arm is pivotally connected to the upper cabinet in a plane which extends through its center of gravity. The cabinet is therefore swingably mounted on the lever arm, and the cabinet is subject to rocking as it moves between its raised and lowered positions. Also, articles stored in the cabinet might change the center of gravity so that the cabinet will tilt about its pivot connections.

Parallel links have also been used to maintain a movable cabinet in a level position. However, two parallel links which are mounted in the same plane can be rotated only in an arc which is less than 180° before the links contact each other. If the links are mounted offset with respect to each other so that they will not contact each other, the links will become unstable and subject to binding once during every 180° of movement when the pivot points of the links are aligned.

SUMMARY

The invention provides a support assembly for permitting an upper cabinet to be moved between raised and lowered positions while maintaining the upper cabinet in an upright, level position. A pair of sprockets are non-rotatably mounted on the upper and lower cabinets, and a link is pivotally mounted on pins which extend through the center of each sprocket. A chain extends around the sprockets. As the link is pivoted about its pivot connection to the lower cabinet, the chain maintains the angular relationship between the sprockets substantially constant and maintains the upper cabinet in a level, upright position. The link can be rotated through a 360° arc without binding or becoming unstable, and the upper cabinet will be maintained level even if the center of gravity of the cabinet changes with respect to the pivot connection to the link.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
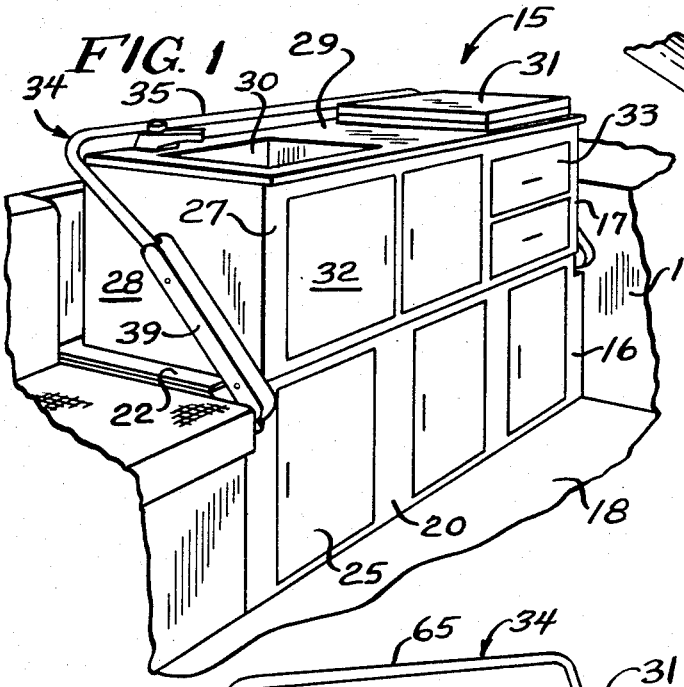
FIG. 1 is a fragmentary perspective view of a galley for a camping trailer which is equipped with a lift assembly in accordance with the invention.
Figure 2:
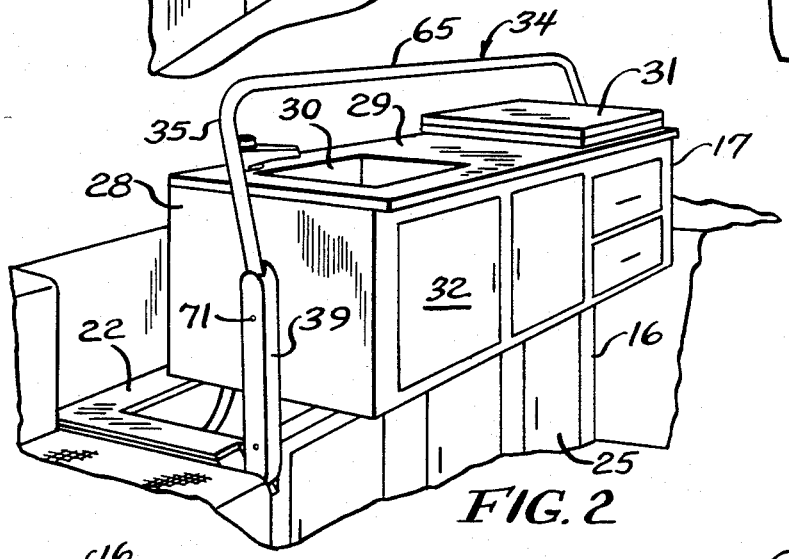
FIG. 2 is a fragmentary perspective view of the galley of FIG. 1 showing the upper cabinet between its raised and lowered positions.
Figure 3:
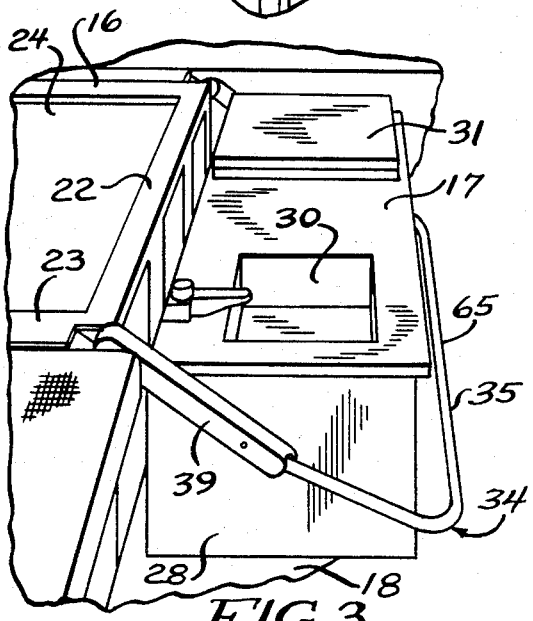
FIG. 3 is a fragmentary sectional view of the galley showing the upper cabinet in its lowered position.

Referring to FIGS. 1–3, a galley assembly 15 includes a lower cabinet 16 and an upper cabinet 17. The lower cabinet 16 is supported by a floor 18 of a vehicle 19, such as a camping trailer. The upper cabinet 17 is movable between an upper or raised position illustrated in FIG. 1 in which it is supported by the lower cabinet 16 and a lowered or storage position illustrated in FIG. 3 in which it is supported by the floor 18.

In the embodiment illustrated, the cabinets 16 and 17 provide a galley assembly. However, it will be understood that the invention is not limited to a galley assembly. The invention is applicable to any two-part structure in which an upper part is movable between raised and lowered positions. Also, the lower part of the structure need not be a cabinet but may simply be a support structure for the upper part. As used herein therefore, the word "cabinet" refers broadly to a structural member and is not limited to a part which has storage space and doors.

The lower cabinet 16 illustrated in the drawings is a box-like structure which includes a front wall 20, a pair of side walls 21 (FIGS. 4 and 5), a back wall (not shown), and a top wall 22. The particular top wall 22 shown in the drawings is provided by relatively narrow panels 23 (FIG. 3) which are mounted on the front, back, and side walls of the lower cabinet to provide a central opening 24 in the top of the lower cabinet. Doors 25 are hingedly mounted on the front wall of the lower cabinet to provide access to the storage space inside of the cabinet.

The upper cabinet 17 is also a box-like structure which includes a bottom wall (not shown), a front wall 27, a pair of side walls 28, a back wall (not shown), and a top wall 29. A sink 30 is supported in an opening in the left side of the top wall, and the right side of the top wall supports gas burners which are covered by a cover 31. Doors 32 are hingedly mounted on the front wall of the upper cabinet to provide access to the storage space inside the cabinet, and a pair of drawers 33 are mounted on the right side of the cabinet.

The upper cabinet is illustrated in its use position in FIG. 1. The bottom wall of the cabinet is supported by the top wall of the lower cabinet, and the top wall of the upper cabinet is positioned at a convenient countertop height. A lift assembly 34 is connected to the two cabinets for moving the upper cabinet from its use position in FIG. 1 to a storage or lowered position illustrated in FIG. 3 in which the upper cabinet is supported by the floor 18. The lift assembly includes a generally U-shaped lift bar 35 which extends along each side of the two cabinets, a pair of sprockets 36 (FIG. 4) which are mounted on the two side walls of the lower cabinet 16, a pair of sprockets 37 (FIG. 4) which are mounted on the two side walls of the upper cabinet 17, and a chain 38 on each side of the cabinets which extends around the sprockets 36 and 37. The sprockets and chain are covered by a molded plastic cover 39 (FIGS. 1–3) which is removably attached to the lift bar 35.

Figure 13:
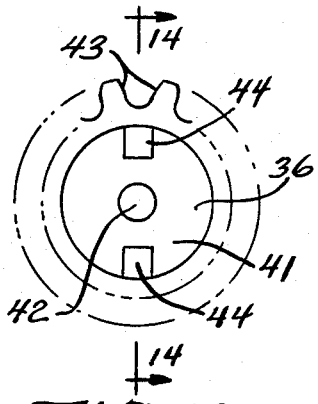
FIG. 13 is a side elevational view, partially in phantom, of one of the sprockets.
Figure 14:
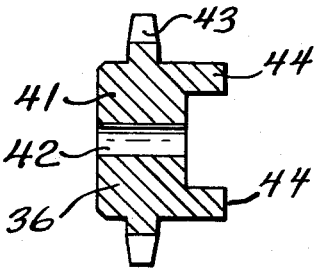
FIG. 14 is a sectional view of the sprocket of FIG. 13 taken along the line 14—14 of FIG. 13.

The sprockets 36 and 37 are identical, and one of the sprockets is illustrated in FIGS. 13 and 14. Each sprocket includes a hub portion 41 having a central opening 42, a plurality of circumferentially arranged sprocket teeth 43, and a pair of axially extending lugs 44.

Figure 11:
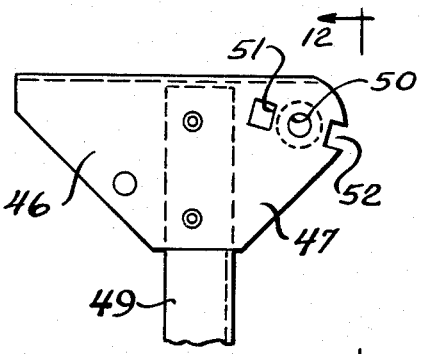
FIG. 11 is a fragmentary view of one of the lower mounting brackets and supporting angles of the lift assembly.
Figure 12:
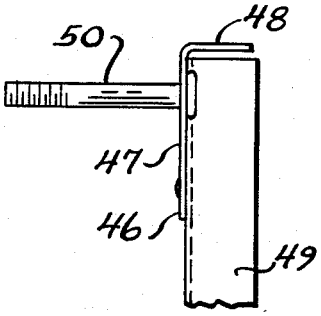
FIG. 12 is a front elevational view of the mounting bracket and angle of FIG. 11.
Figure 15:
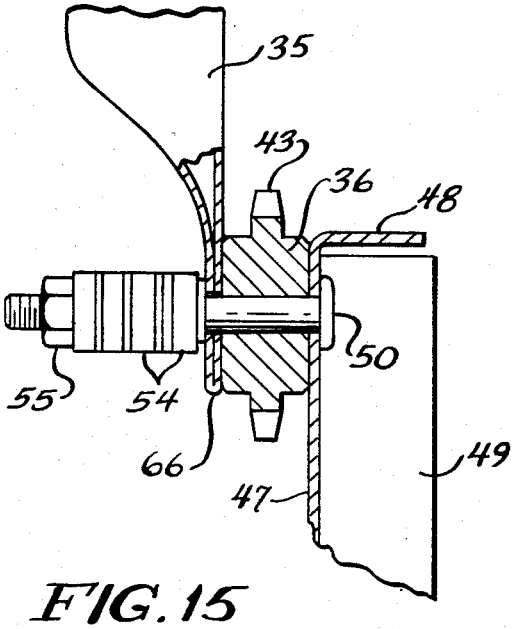
FIG. 15 is a fragmentary sectional view showing the mounting of the lower sprocket and lift bar on the lower mounting bracket.

Each of the sprockets 36 are mounted on the lower cabinet 16 by a mounting bracket 46 illustrated in FIGS. 11, 12, and 15. The mounting bracket 46 includes a vertically extending plate portion 47 and a horizontally extending upper flange 48. The plate portion is riveted to a vertically extending angle 49 which is attached to the side wall 21 of the lower cabinet 16 and which is supported by the bottom wall of the lower cabinet or the floor 18. A mounting bolt or pin 50 extends horizontally through an opening in the plate portion of the mounting bracket 46, and a rectangular opening 51 and a rectangular notch 52 are provided in the plate portion adjacent the mounting pin 50. The head of the mounting pin is preferably welded to the mounting plate to prevent rotation of the pin.

The sprocket 36 is mounted on the bracket 46 by inserting the pin 50 through the central opening 42 in the sprocket (FIG. 15), and the lugs 44 on the sprocket are inserted into the opening 51 and the notch 52 to fix the sprocket against rotation. The end of the lift bar 35 is provided with an opening 53 (see also FIG. 9) for rotatably or pivotally mounting the lift bar on the mounting pin 50, and the lift bar is retained on the mounting pin by a plurality of washers or bushings 54 and a nut 55 which is screwed onto the threaded end of the mounting pin.

As can be seen in FIGS. 4–7, the upper front corners of the lower cabinet 16 are mitered so that the mounting brackets 46 are exposed. The ends of the lift bar 35 are thereby permitted to rotate freely between raised and lowered positions without interference from the walls of the cabinet.

Figure 16:
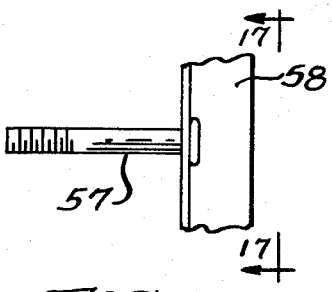
FIG. 16 is a fragmentary front elevational view of the mounting pin and support angle for one of the upper sprockets.
Figure 17:
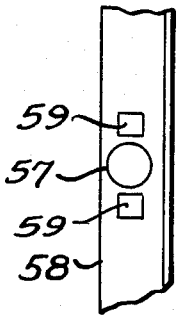
FIG. 17 is a side elevational view taken along the line 17—17 of FIG. 16.

Each of the sprockets 37 are mounted on the upper cabinet 17 by a mounting bolt or pin 57 (FIGS. 16 and 17) which extends through an opening in a vertically extending angle 58. The mounting pin is preferably non-rotatably attached to the angle by welding the head of the pin to the angle. Each of the angles 58 is attached to the inside of one of the side walls 28 of the upper cabinet, and the bottom of the angle is provided with a horizontal flange which is attached to the bottom wall of the upper cabinet. The mounting pin 57 extends laterally outwardly through an opening in the side wall of the cabinet.

Figure 18:
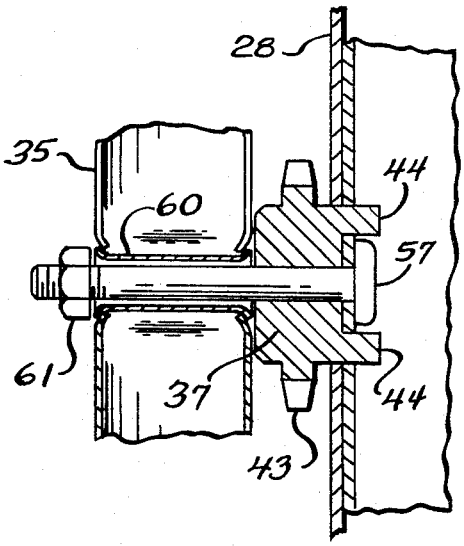
FIG. 18 is a fragmentary sectional view showing the mounting of the upper sprocket and lift bar on the upper mounting pin of FIG. 16.

The angle 58 is provided with a pair of rectangular openings 59 (FIG. 17) adjacent the mounting pin 57. The sprocket 37 is nonrotatably mounted on the mounting pin by inserting the pin through the central opening of the sprocket and inserting the lugs 44 of the sprocket through the rectangular openings 59 and of the angle (FIG. 18). The opening in the side wall 28 of the upper cabinet through which the mounting pin extends is large enough to accommodate the lugs 44 of the sprocket. The mounting pin 58 extends through a bushing 60 (FIG. 18) in the lift bar 35 to rotatably connect the lift bar to the upper cabinet, and a nut 61 retains the lift bar on the mounting pin.

Figure 9:
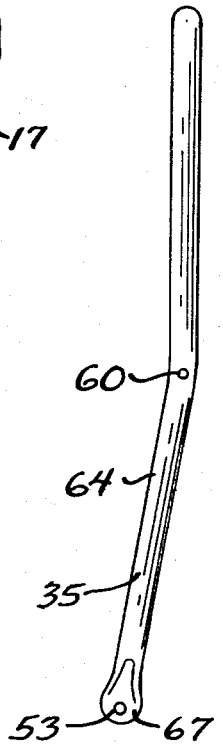
FIG. 9 is a side elevational view of the lift bar.
Figure 8:
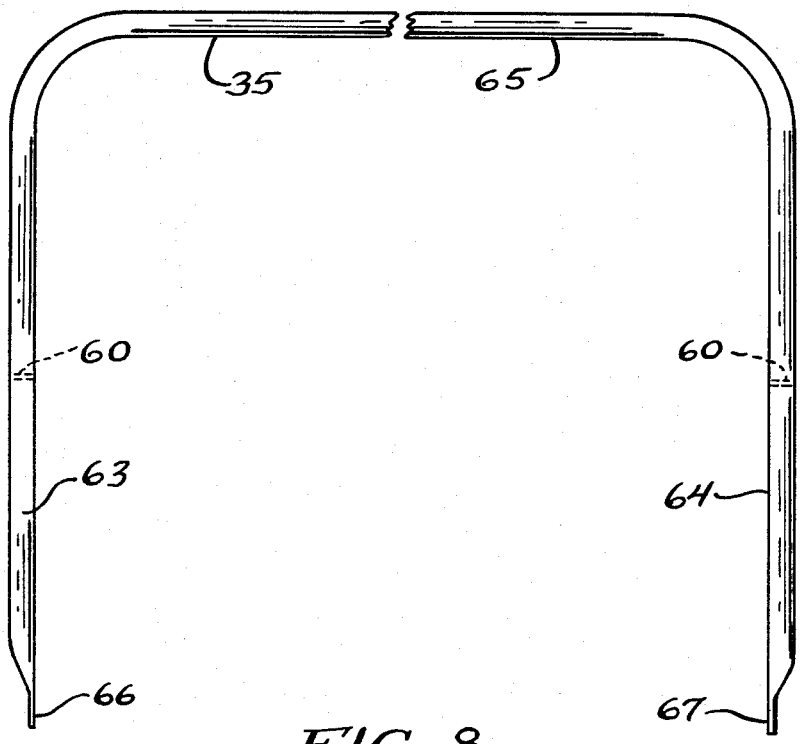
FIG. 8 is a plan view, partially broken away, of the lift bar.
Figure 10:
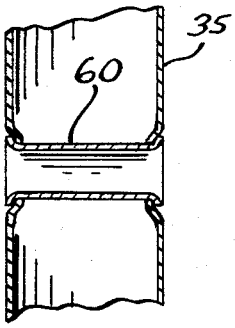
FIG. 10 is an enlarged fragmentary sectional view of a portion of the lift bar.

The details of the lift bar 35 are shown in FIGS. 8–10. The U-shaped lift bar includes a pair of side legs 53 and 64, which extend along the sides of the upper cabinet, and a central handle portion 65, which extends behind the upper cabinet when the upper cabinet is in its upper position (FIG. 1) and which extends in front of the upper cabinet when the upper cabinet is in its lowered position (FIG. 3). The lift bar is formed from a steel tube, and the end portions 66 and 67 are flattened to facilitate attaching the lift bar to the mounting pins of the lower cabinet. The bushings 60 through which the mounting pins 57 on the upper cabinet extend can be steel tubes which are inserted through openings in the lift bar. The bushings are retained in the lift bar by flaring the ends of the bushings as shown in FIG. 10. As can be seen in FIG. 9, the leg portions of the lift bar are angled at the bushings 60 to provide the desired leverage or lifting angle when the upper cabinet is in its lowered position.

The chain 38 (FIGS. 4–7) which extends around the sprockets 36 and 37 on each side of the cabinets is a conventional link chain or sprocket chain which meshes with the teeth of the sprockets. The chain is preferably formed from two portions 38*a* and 38*b*, the ends of which are joined by a pair of turnbuckles 69 and 70. The turnbuckles permit the tension of the sprocket chain to be adjusted as desired and compensates for manufacturing tolerance and wear.

The plastic cover 39 (FIGS. 1–3) covers the sprocket and chain on each side of the cabinets. The cover is removably attached to the lift bar by a pair of screws 71 (FIG. 2) which are inserted The sprockets and chains of the lift assembly prevent the upper cabinet 17 from rotating as the cabinet moves between its upper position in FIG. 1 and its lowered position in FIG. 3. The sprockets are prevented from rotating with respect to the upper and lower cabinets, and the chain which connects each pair of sprockets 36 and 37 maintains the upper sprocket 37 in the same angular orientation with respect to the lower sprocket 36 as the upper cabinet is moved by the lift bar 35. The upper cabinet is thereby maintained level at all times.

Figure 4:
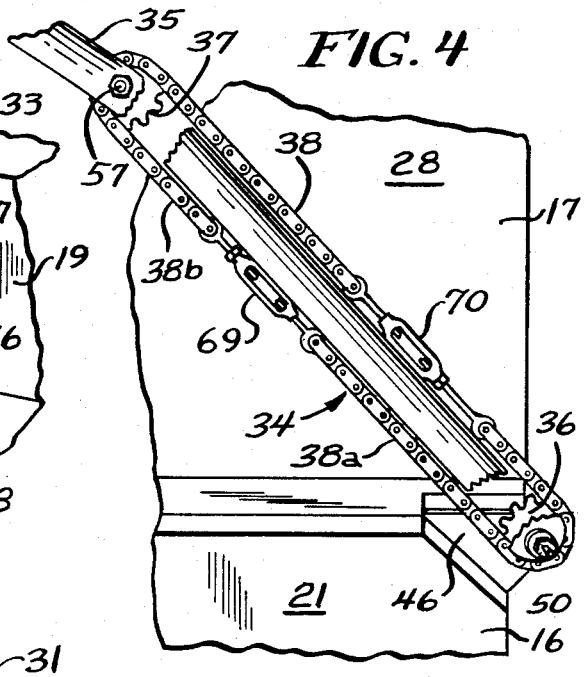
FIG. 4 is an enlarged fragmentary view of a portion of the lift assembly when the upper cabinet is in its raised position.
Figure 5:
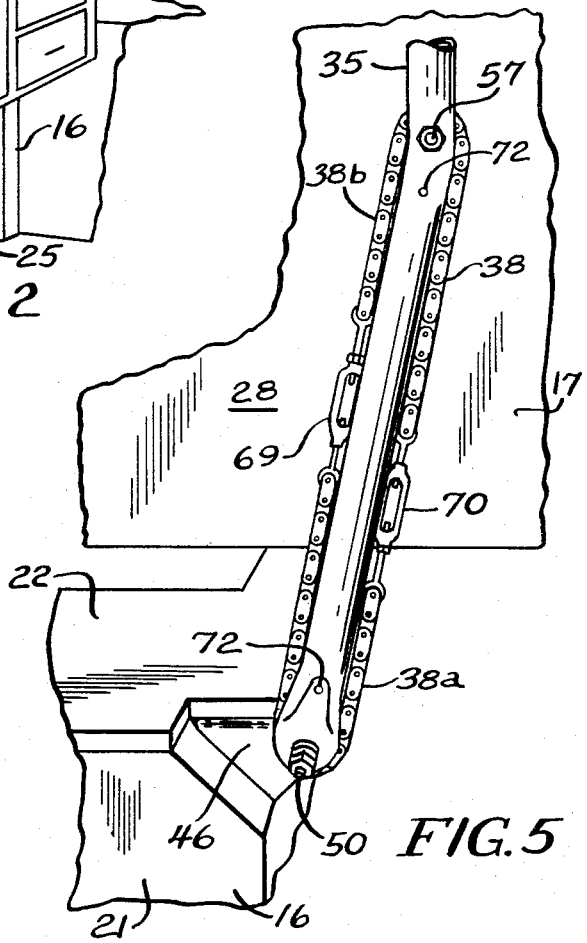
FIG. 5 is an enlarged fragmentary view of a portion of the lift assembly when the upper cabinet is in an intermediate position.

The relationship between the lift bar, the sprockets 36 and 37, and the chain 38 as the upper cabinet moves is shown in FIGS. 4–7. In FIG. 4 the upper cabinet 17 is in its upper position and is supported by the lower cabinet 16. The turnbuckle 69 is closer to the upper sprocket 37 than is the turnbuckle 70. The upper cabinet is moved by lifting the handle portion 65 of the lift bar and pivoting the lift bar forwardly on the pivot connections provided by the pins 50 which extend through the lower sprockets 36. In FIG. 5 the upper cabinet has been moved upwardly and forwardly from its FIG. 4 position. The sprockets 36 and 37 are prevented from rotation relative to the lower and upper cabinets 16 and 17, respectively, and rotation of the lift bar relative to the lower sprocket 36 causes the links of the chain to engage different teeth of the lower sprocket as the lift bar rotates. Since the length of the chain is constant, the upper sprocket 37 will be maintained in the same angular orientation or relationship with respect to the lower sprocket 36, i.e., the tooth of the upper sprocket 37 which is at the 12 o'clock position in FIG. 4 will still be in the 12 o'clock position in FIG. 5. The upper sprocket 37 is translated with respect to the lower sprocket 36 by movement of the lift bar, but the upper sprocket is not rotated with respect to the lower sprocket. The upper cabinet will therefore be maintained level by the upper sprocket. The movement of the chain relative to the sprocket is indicated in FIG. 5 by the fact that the turnbuckle 70 has moved closer to the upper sprocket and the turnbuckle 69 has moved away from the upper sprocket.

Figure 6:
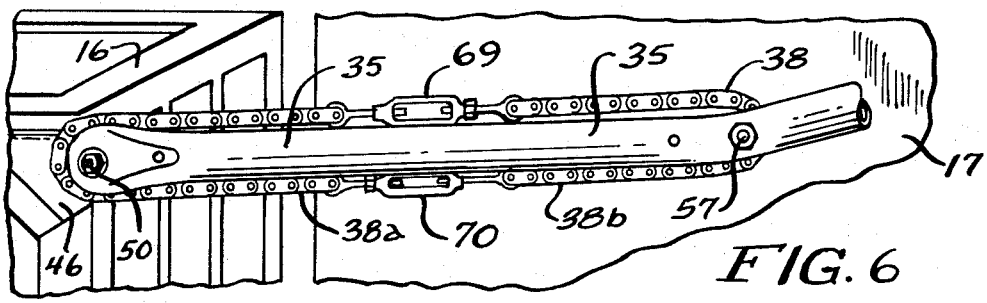
FIG. 6 is an enlarged fragmentary view of a portion of the lift assembly when the upper cabinet is in another intermediate position.

In FIG. 6 the lift bar 35 has been pivoted to a generally horizontal position. The tooth of the upper sprocket 37 which was in the 12 o'clock position in FIGS. 4 and 5 is still in the 12 o'clock position, and the turnbuckle 70 has moved closer to the upper sprocket 37. The upper cabinet 17 is maintained level.

Figure 7:
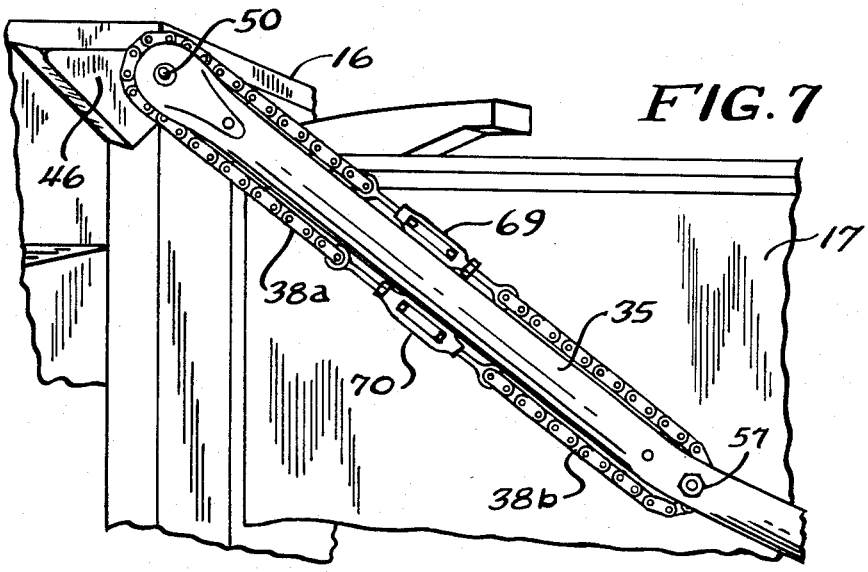
FIG. 7 is an enlarged fragmentary view of a portion of the lift assembly when the upper cabinet is in its lowered position.

In FIG. 7 the upper cabinet has been moved to its lowered position. The tooth of the upper sprocket 37 which was in the 12 o'clock position in FIGS. 4–6 is still in the 12 o'clock position, and the turnbuckle 70 has moved closer to the upper sprocket 37 and has passed the turnbuckle 69.

The upper cabinet can be returned to its raised position above the lower cabinet by lifting the handle portion of the lift bar and pivoting the lift bar about its pivot connections to the lower cabinet. The chain 38 will maintain the upper sprocket 37 in the same angular relationship with respect to the lower sprocket 36, and the upper cabinet will be maintained level.

It is thus seen that the upper cabinet will be maintained level by the lift assembly regardless of the location of the center of gravity of the upper cabinet with respect to the mounting pins 57 on the upper cabinet. The lift bar 35 provides a hand grip for raising and lowering the upper cabinet and acts as a torsion bar to even out forces on the lift assembly to make the upper cabinet move smoothly without twisting or binding. Although the lift bar is rotated through an arc of less than 360° in the drawings, the structure of the lift assembly permits the lift bar to be rotated through a 360° arc if desired without binding.

The handle portion 65 of the lift bar provides a convenient gripping portion for grasping the lift bar and pivoting the lift bar and the upper cabinet about the pivot connections to the lower cabinet. The handle portion also provides a convenient towel bar when the upper cabinet is in its use position in FIG. 1. However, if desired, the lift bar need not extend between the two sides of the upper cabinet. Rather, separate links can extend between the lower mounting pin 50 and the upper mounting pin 57 on each side of the cabinets. The upper cabinet could be moved by grasping the upper cabinet itself, and the separate links on each side of the cabinet would support the upper cabinet in the same way as previously described.

Also, although I have described the use of conventional sprockets and chains to maintain the upper cabinet level, it will be understood that equivalent structures such as gears, pulleys, and the like which are connected by a cable, belt, or the like which will not slip with respect to the wheels or gears could also be used.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. In a vehicle having first and second cabinets, the first cabinet being supported by a floor of the vehicle and the second cabinet being movable between a use position above the first cabinet and a storage position below the use position, the improvement comprising a first wheel non-rotatably mounted on the first cabinet with the axis thereof extending generally horizontally and generally perpendicularly to the direction in which the second cabinet moves, a second wheel non-rotatably mounted on the second cabinet with the axis thereof extending generally horizontally and generally perpendicularly to the direction in which the second cabinet moves, a link rotatably connected to the first and second cabinets adjacent the first and second wheels and extendings therebetween for supporting the second cabinet as it moves between the use position and storage position, and cable means extending around the first and second wheels and engageable with the wheels for maintaining the wheels in a substantially constant angular relationship as the second cabinet moves between the use position and the storage position whereby the second cabinet is maintained in a substantially upright position as it moves.

2. The structure of claim 1 in which the first and second wheels are sprockets and the cable means comprises a chain which is engaged with the sprockets.

3. The structure of claim 2 including a turnbuckle joining portions of the chain whereby the tension of the chain can be adjusted.

4. The structure of claim 1 including a bracket mounted on the first cabinet and a pin extending through the bracket and the axis of the first wheel, the link being rotatably mounted on the pin.

5. The structure of claim 1 in which the first wheel includes lug means extending through an opening in the bracket for preventing relative rotation between the first wheel and the bracket.

6. The structure of claim 1 including a first bracket mounted on the first cabinet, a first pin extending through the first bracket and the axis of the first wheel, a second bracket mounted on the second cabinet, and a second pin extending through the second bracket and the axis of the second wheel, the link being rotatably mounted on the first and second pins.

7. The structure of claim 6 in which the first wheel includes lug means which extend through an opening in the bracket for preventing relative rotation between the first wheel and the bracket.

8. The structure of claim 6 in which the first and second wheels are sprockets and the cable means comprises a chain which is engaged with the sprockets.

9. The structure of claim 8 including a turnbuckle joining portions of the chain whereby the tension of the chain can be adjusted.

10. In a vehicle having first and second cabinets, each of the cabinets having a top and a pair of sides, the first cabinet being supported by a floor of the vehicle and a second cabinet being movable between a use position in which the second cabinet is supported on the top of the first cabinet and a storage position in which the second cabinet is supported by the floor of the vehicle, the improvement comprising a pair of lift assemblies connected to the sides of the first and second cabinets, each of the lift assemblies including a first pin mounted on a side of the first cabinet and extending generally horizontally and generally perpendicularly to the direction in which the second cabinet moves, a first sprocket non-rotatably mounted on the first pin, a second pin mounted on a side of the second cabinet and extending generally horizontally and generally perpendicularly to the direction in which the second cabinet moves, a second sprocket non-rotatably mounted on the second pin, a link extending between the first and second pins and rotatably connected to each pin for supporting the second cabinet as it moves between the use position and storage position, and a chain extending around the first and second sprockets for maintaining the sprockets in a substantially constant angular relationship as the second cabinet moves between the use position and the storage position whereby the second cabinet is maintained in a substantially upright position as it moves.

11. The structure of claim 10 including a turnbuckle joining portions of the chain whereby the tension of the chain can be adjusted.

12. The structure of claim 10 including a bracket mounted on the first cabinet, the first pin exxtending through the bracket and the center of the first sprocket, the first sprocket including lug means extending through an opening in the bracket for preventing relative rotation between the first sprocket and the bracket.

13. The structure of claim 10 including a first bracket mounted on the first cabinet, the first pin extending through the first bracket and the second of the first sprocket, a second bracket mounted on the second cabinet, the second pin extending through the second bracket and the center of the second sprocket, the first sprocket including lug means extendings through an opening in the first bracket for preventing relative rotation between the first sprocket and the first bracket and the second sprocket including lug means extending through an opening in the second bracket for preventing relative rotation between the second sprocket and the second bracket.

* * * * *